US011039697B2

(12) United States Patent
Shultz

(10) Patent No.: US 11,039,697 B2
(45) Date of Patent: Jun. 22, 2021

(54) ICE SCOOP

(71) Applicant: Mile High Equipment LLC, Denver, CO (US)

(72) Inventor: Nathan Lee Shultz, Aurora, CO (US)

(73) Assignee: Mile High Equipment LLC, Denver, CO (US)

( * ) Notice: Subject to any disclaimer, the term of this patent is extended or adjusted under 35 U.S.C. 154(b) by 0 days.

(21) Appl. No.: 16/559,626

(22) Filed: Sep. 3, 2019

(65) Prior Publication Data

US 2021/0059438 A1 Mar. 4, 2021

(51) Int. Cl.
*A47F 13/08* (2006.01)

(52) U.S. Cl.
CPC ..... *A47F 13/08* (2013.01)

(58) Field of Classification Search
CPC . A47F 13/08; A01B 1/02; F25C 5/043; F25C 2400/04
See application file for complete search history.

(56) References Cited

U.S. PATENT DOCUMENTS

| | | | | |
|---|---|---|---|---|
| 440,059 | A | 11/1890 | Quigley | |
| 662,284 | A | 11/1900 | Morrell | |
| 695,359 | A | 3/1902 | Wolfe | |
| 2,511,560 | A | 6/1950 | Bechmann | |
| 3,840,261 | A | 10/1974 | Fulkerson | |
| D254,705 | S | 4/1980 | Whiteside | |
| 5,575,520 | A * | 11/1996 | Northcutt | A01K 1/01 141/108 |
| 5,580,111 | A * | 12/1996 | Bohn | E01H 1/1206 294/1.3 |
| D404,855 | S * | 1/1999 | Dotson | A01K 1/0114 D30/162 |
| D694,592 | S | 12/2013 | Hukill | |
| 2003/0150627 | A1 | 8/2003 | Timmons | |
| 2007/0170732 | A1 | 7/2007 | Platt | |
| 2009/0058115 | A1 * | 3/2009 | Freedman | A01K 1/0114 294/177 |
| 2009/0140536 | A1 | 6/2009 | Claypool | |

(Continued)

FOREIGN PATENT DOCUMENTS

EP 1048252 A2 11/2000

OTHER PUBLICATIONS

Amazon "San Jamar Si5500 Polycarbonate Saf-t-scoop Only" Source: https://www.amazon.com/San-Jamar-SI5500-Polycarbonate-Saf-T-Scoop/dp/B005K8N7T8/—Date Accessed: Mar. 6, 2019.

(Continued)

*Primary Examiner* — Stephen A Vu
(74) *Attorney, Agent, or Firm* — Lempia Summerfield Katz LLC

(57) ABSTRACT

An ice scoop includes a barrier having a first side and a second side opposite the first side. The ice scoop also includes a scoop portion extending away from the first side of the barrier, and a handle portion extending away from the second side of the barrier. The handle portion includes at least one wall extending away from the second side of the barrier. The at least one wall of the handle portion and the barrier define a cavity. The handle portion also includes a handhold attached to a wall of the at least one wall, the barrier, or the wall and the barrier within the cavity.

14 Claims, 8 Drawing Sheets

(56) References Cited

U.S. PATENT DOCUMENTS

| | | | | |
|---|---|---|---|---|
| 2011/0285159 | A1* | 11/2011 | Workman | A47F 13/08 294/178 |
| 2014/0265399 | A1 | 9/2014 | Young | |
| 2015/0167265 | A1* | 6/2015 | Becattini, Jr. | B07B 1/02 294/1.3 |
| 2015/0351307 | A1 | 12/2015 | Dick | |

OTHER PUBLICATIONS

Amazon "Sand Scoops Heavy Duty Galvanized Metal" Source: https://www.amazon.com/Heavy-Galvanized-Metal-Sand-Scoop/dp/B00AYJG9J8/—Date Accessed: Mar. 6, 2019.

Global Industrial "Trynex Heavy Duty Hand Scoop D6767 Each" Source: https://www.globalindustrial.com/p/storage/bins-totes-containers/bulk/heavy-duty-hand-scoop—Date Accessed: Mar. 7, 2019.

Hubert "San Jamar 4-6 Oz Clear Polycarbonate Banquet Ice Scoop" Source: https://www.hubert.com/product/89932/San-Jamar-4-6-oz-Clear-Polycarbonate-Banquet-Ice-Scoop-2-12Dia-x-7-12L—Date Accessed: Mar. 6, 2019.

* cited by examiner

ICE SCOOP

FIELD

The present embodiments relate to a scoop and, more specifically, an ice scoop.

BACKGROUND

Commercial icemakers are used in a number of different types of foodservice and hospitality establishments. For example, commercial icemakers are used in bars, restaurants, hotels, hospitals, and other establishments for chilling drinks and keeping food cold during transport. In any of these establishments, a number of users may retrieve ice from an icemaker over the course of a day. For example, a number of bartenders and/or servers working at a bar or a restaurant may retrieve ice from an icemaker over the course of a day.

Improper handling of the ice may introduce contaminants to the ice, which may cause foodborne illness. To prevent skin-to-ice contact and reduce the risk of contamination when a user is retrieving ice from the icemaker, the establishment may establish ice-handling procedures. For example, a bartender working at a bar may be required to put on a glove to retrieve ice each time the bartender makes a drink. The bartender may, however, misplace the glove, use a contaminated glove, or ignore these procedures when the bar gets busy.

SUMMARY

In order to reduce the risk of contamination of ice within an icemaker, an ice scoop that surrounds a hand of a user of the ice scoop is provided. The ice scoop includes a barrier, and a scoop portion and a handle portion extending away from opposite sides of the barrier, respectively. The handle portion includes at least one wall extending away from the barrier, and a handle attached to a wall of the at least one wall and/or the barrier. The at least one wall of the handle portion and the barrier define a cavity into which the hand of the user is insertable.

In a first aspect, an ice scoop includes a barrier having a first side and a second side opposite the first side. The ice scoop also includes a scoop portion extending away from the first side of the barrier, and a handle portion extending away from the second side of the barrier. The handle portion includes at least one wall extending away from the second side of the barrier, and a handhold attached to a wall of the at least one wall, the barrier, or the wall and the barrier within the cavity. The at least one wall of the handle portion and the barrier define a cavity.

In a second aspect, a scoop includes a barrier having a first side and a second side opposite the first side. The scoop also includes a scoop portion extending away from the first side of the barrier. The scoop portion has a scooping wall. The scoop includes a handle portion extending away from the second side of the barrier. The handle portion includes at least one hand protection wall extending away from the second side of the barrier, and a handhold attached to a hand protection wall of the at least one hand protection wall, the barrier, or the hand protection wall and the barrier within the recess. The at least one hand protection wall and the barrier define a recess. The at least one hand protection wall surrounds the handhold in a plane through the handhold and perpendicular to the scooping wall.

In a third aspect, an ice scoop includes a barrier having a first side and a second side opposite the first side. The ice scoop also includes a scoop portion extending away from the first side of the barrier. The scoop portion has a scooping wall. The ice scoop includes a handle portion extending away from the second side of the barrier. The handle portion includes a first hand protection wall, a second hand protection wall opposite the first hand protection wall, and a third hand protection wall and a fourth hand protection wall extending between the first hand protection wall and the second hand protection wall at opposed sides of the first hand protection wall and the second hand protection wall, respectively. The first hand protection wall, the second hand protection wall, the third hand protection wall, and the fourth hand protection wall extend away from the barrier and, with the barrier, defining a hollow. The handle portion also includes a handhold attached to the first hand protection wall, the second hand protection wall, the barrier, or any combination thereof within the hollow.

DETAILED DESCRIPTION OF THE DRAWINGS

An ice scoop of the present embodiments includes a barrier that separates a scoop portion and a handle portion. The handle portion includes one or more walls extending away from a side of the barrier. The one or more walls and the barrier define a cavity into which a hand of the user is insertable. The handle portion includes a handle disposed within the recess. The handle may be positioned closer to the barrier than to an end of the handle portion, such that the hand of the user is completely disposed within the cavity. The hand of the user is completely surrounded by the one or more walls in a plane through the handle and/or parallel to the side of the barrier from which the one or more walls extend.

The positioning of the handle relative to the barrier and/or the end of the handle portion and the surrounding of the hand by the one or more walls helps reduce the risk of skin-to-ice contact, and thus, contamination of ice within an icemaker, when the user retrieves ice from icemaker. The ice scoop of one or more of the present embodiments is easy to use. The user may thus be more likely to use the ice scoop than other procedures of the prior art to prevent contamination of the ice within the icemaker. For example, due to the comparative ease of use, the user may be more likely to use the ice scoop every time ice is retrieved than putting on a disposable glove every time ice is retrieved.

Figure 1:
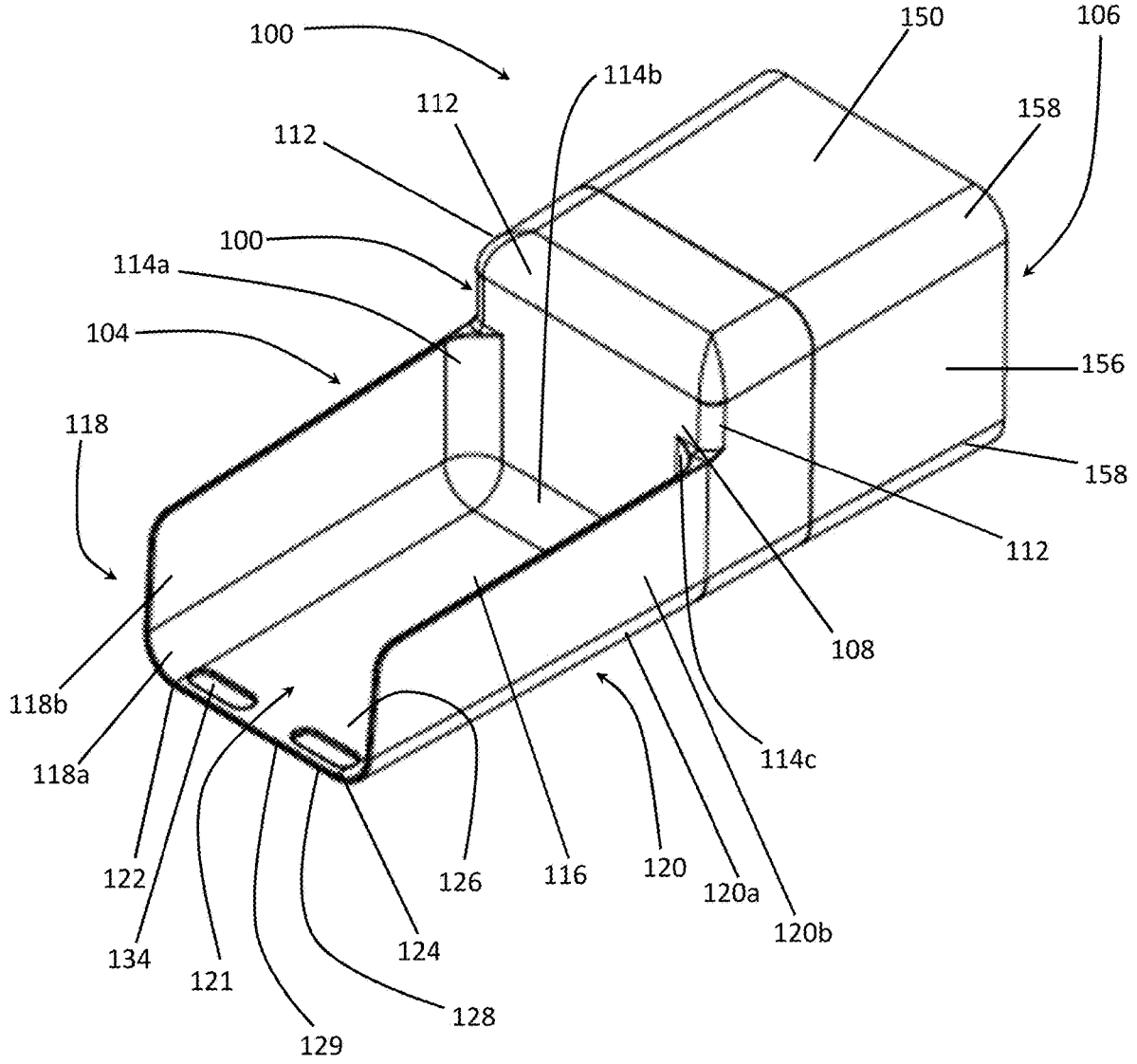
FIG. 1 is a first perspective view of one embodiment of a scoop.

FIG. 1-7 illustrate a first embodiment of an ice scoop 100. Referring to Referring to FIG. 1, the ice scoop 100 includes a barrier 102 (e.g., a wall) that separates a scoop portion 104 of the ice scoop 100 from a handle portion 106 of the ice scoop. The barrier 102 thus separates the ice being scooped by the scoop portion 104 from a hand of a user disposed within the handle portion 106 of the ice scoop 100.

The barrier 102 has a first side 108 that faces the scoop portion 104 and a second side 110 (see FIG. 6) that faces the handle portion 106. The second side 110 of the barrier 102 is opposite the first side 108 of the barrier 102, and at least a portion of the second side 110 of the barrier 102 may be parallel to at least a portion of the first side 108 of the barrier 102. In one embodiment, at least a portion of the second side 110 of the barrier 102 is at an angle relative to at least a portion of the first side 108 of the barrier 102.

Figure 3:
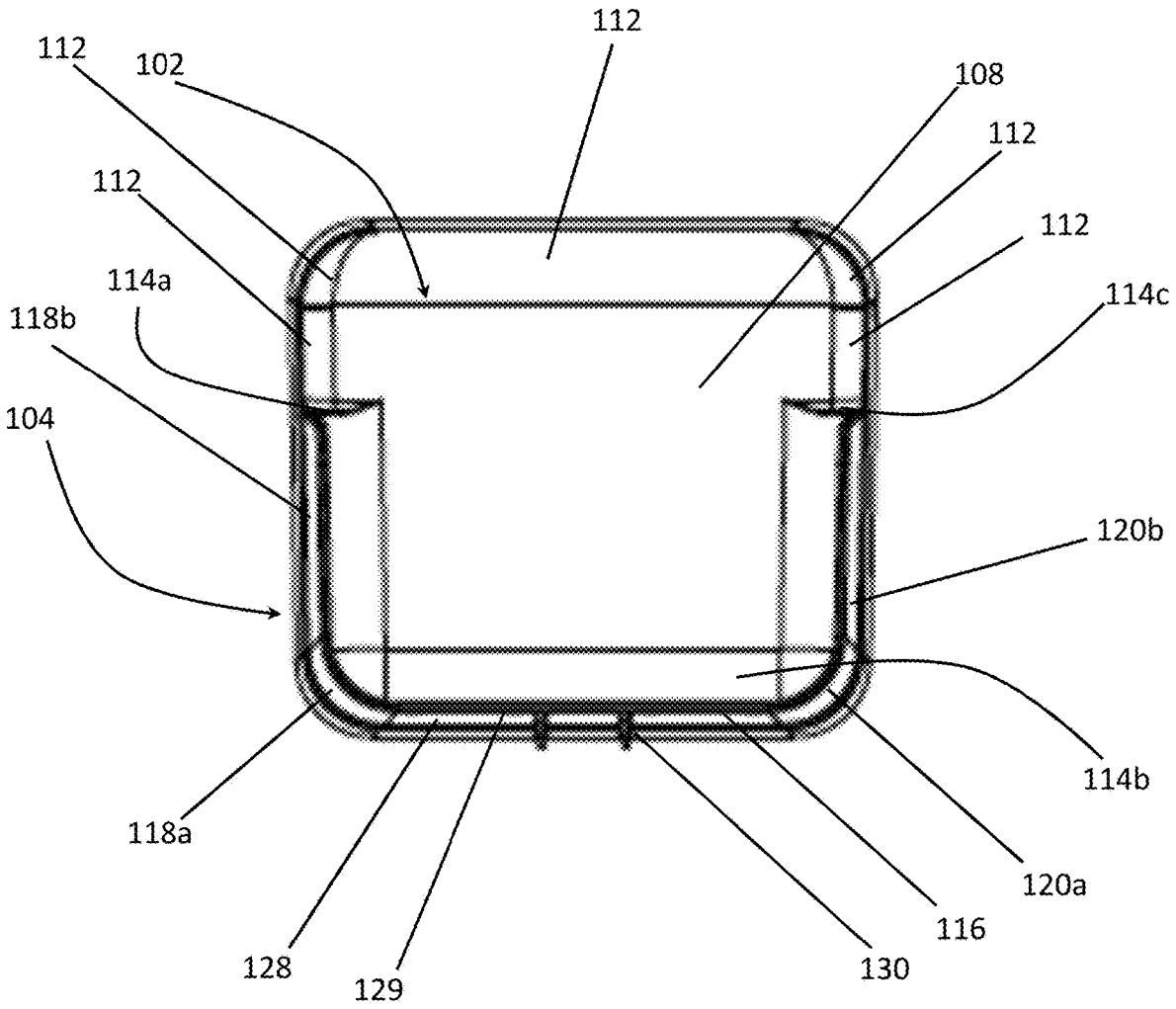
FIG. 3 is a front view of the scoop of FIG. 1.

The barrier 102 may be any number of sizes and shapes. For example, as shown in FIGS. 1 and 3, the barrier 102 may be rectangular. Other shapes may be provided. For example, the barrier 102 may be circular in shape or oval-shaped. In one embodiment, the barrier 102 is rectangular (e.g., square) with rounded corners. In another embodiment, the barrier 102 includes one or more portions that curve away from the scoop portion 104 and/or the handle portion 106, respectively.

The width, the height, the thickness, and/or other dimensions of the barrier 102 may be any number of different sizes. For example, the width and the height of the barrier 102 may at least partially define a size of a cavity of the handle portion 106, in which the hand of the user is positioned, and the width of the barrier 102 may partially define a size of the scoop portion 104 of the ice scoop 100. For example, the barrier 102 may be sized (e.g., with a width and a height) such that the size of the cavity of the handle portion 106 is large enough for a number of different sized hands to be inserted into the handle portion 106. Alternatively or additionally, the barrier 102 may be sized such that a particular volume of ice may be disposed (e.g., housed) within the scoop portion 104 of the scoop 100.

The scoop portion 104 extends in a direction away from the first side 108 of the barrier 102, and the handle portion 106 extends in a direction away from the second side 110 of the barrier 102. For example, the scoop portion 104 is directly connected to (e.g., abuts) the first side 108 of the barrier 102 and extends away from the first side 108 of the barrier 102, and the handle portion 106 is directly connected to (e.g., abuts) the second side 110 of the barrier 102 and extends away from the second side 110 of the barrier 102. In one embodiment, the scoop portion 104 is directly connected to (e.g., abuts) the handle portion 106 without being directly connected to the barrier 102, or is directly connected to (e.g., abuts) the handle portion 106 in addition to the barrier 102. For example, as shown in FIG. 1, the barrier 102 is rectangular, and the handle portion 106 includes wall portions 112 (e.g., curved wall portions) connecting the handle portion 106 to the barrier 102. Supports 114 of the scoop portion 104 are directly connected to the first side 108 of the barrier 102 and/or the wall portions 112 of the handle portion 106. Other configurations may be provided.

In one embodiment, at least a portion of the scoop portion 104 extends away from the first side 108 of the barrier 102 in a direction perpendicular to the first side 108 of the barrier 102, and at least a portion of the handle portion 106 extends away from the second side 110 of the barrier 102 in a direction perpendicular to the second side 110 of the barrier 102. In another example, the scoop portion 104 extends away from the first side 108 of the barrier 102 in one or more non-perpendicular directions relative to the first side 108 of the barrier 102, and/or the handle portion 106 extends away from the second side 110 of the barrier 102 in one or more non-perpendicular directions relative to the second side 110 of the barrier 102.

The scoop portion 104 includes a bottom scoop wall 116 and two opposed side scoop walls 118, 120. The bottom scoop wall 116 and the two opposed side scoop walls 118, 120 partially enclose a volume 121 in which ice or other solids, liquids, and/or materials may be housed and/or transported. The scoop portion 104 may be configured differently. For example, the scoop portion 104 may not include one or both of the two opposed side scoop walls 118, 120.

The bottom scoop wall 116 has opposed sides 122, 124, a first surface 126, and a second surface 128 opposite the first surface 126. The first surface 126 faces the volume 121, and the second surface 128 faces away from the volume 121. The bottom scoop wall 116 also has one or more front edges 129 (e.g., a front edge or a scooping edge) that extend between the two opposed sides 122, 124.

The two opposed side scoop walls 118, 120 extend away from the opposed sides 122, 124 of the bottom scoop wall 116 and/or the first surface 126 of the bottom scoop wall 116. In the example shown in FIGS. 1-7, the two opposed side scoop walls 118, 120 are curved and each include a curved portion 118*a*, 120*a* and a straight portion 118*b*, 120*b*, respectively. For example, the curved portions 118*a*, 120*a* extend away from the opposed sides 122, 124, respectively, in any number of different shaped arcs until the two opposed side scoop walls 118, 120 face in, for example, a direction perpendicular to the first surface 126 of the bottom scoop wall 116. The straight portions 118*b*, 120*b* then extend away from the curved portions 118*a*, 120*a*, respectively.

Other configurations may be provided. For example, the opposed side scoop walls 118, 120 may not include the curved portions 118*a*, 120*a*, respectively, or the opposed side scoop walls 118, 120 may each include one or more additional straight portions instead of the curved portions 118*a*, 120*a*, respectively. In another example, the opposed side scoop walls 118, 120 are connected to and extend away from the first surface 126 of the bottom scoop wall 116. In yet another example, the scoop portion 104 does not include any opposed side scoop walls (e.g., does not include the opposed side scoop walls 118, 120).

Figure 4:
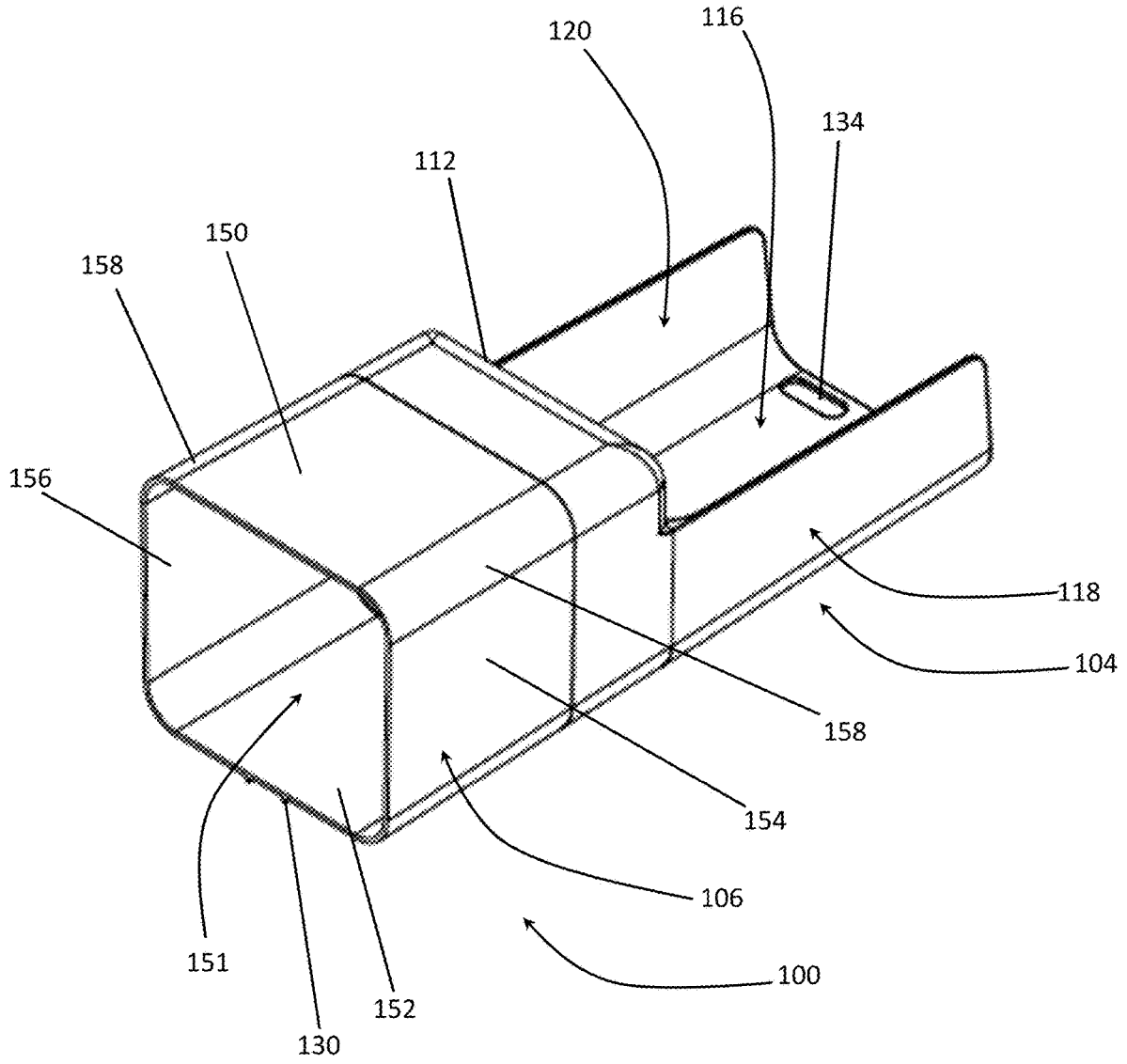
FIG. 4 is a second perspective view of the scoop of FIG. 1.

The scoop portion 104 may include additional features. For example, as shown in FIG. 3, the scoop portion 104 may include one or more extensions 130 (e.g., one or more ribs) that extend away from the second surface 128 of the bottom scoop wall 116. For example, as shown in FIGS. 3 and 4, the scoop portion 104 may include two ribs 130 that extend away from second surface 128 of the bottom scoop wall 116. The two ribs 130 may extend from a front edge 129 of the scoop portion 104 (e.g., a front edge at the second surface 128 of the bottom scoop wall 116) along an entire length or less than the entire length of the ice scoop 100 in directions parallel to each other, respectively (e.g., along the length of the ice scoop 100). The two ribs 130 may be spaced apart from each other any number of distances and/or may extend from a position on the second surface 128 of the bottom scoop wall 116 offset relative to the front edge of the second surface 128 of the bottom scoop wall 116. In other embodiments, the two ribs 130 may extend in different directions.

In other embodiments, the ice scoop 100 may include additional or fewer ribs on additional and/or different surfaces of the ice scoop 100. For example, the scoop portion 104 includes additional ribs 130 extending away from the second surface 128 of the scoop portion 104 (e.g., four ribs 130) and/or another surface of the ice scoop 100 (e.g., one or more surfaces of the opposed side scoop walls 118, 120).

The ribs 130 may serve any number of functions and provide a number of benefits. For example, when the user scoops ice, for example, with the ice scoop 100, the ribs 130 contact a surface of an ice machine, such that the second surface 128 of the bottom scoop wall 116 is offset relative to the surface of the ice machine during the scooping. This may reduce an amount of friction between the ice scoop 100 and the surface of the ice machine during the scooping. Alternatively or additionally, the ribs 130 may correspond to recesses or extensions on or within the ice machine, and the ribs 130 may interact with the recesses or the extensions on or within the ice machine for storage of the ice scoop 100 on or within the ice machine. The ribs 130 may also be provided for strength and may help prevent breaking of the ice scoop 100 during use.

Figure 2:
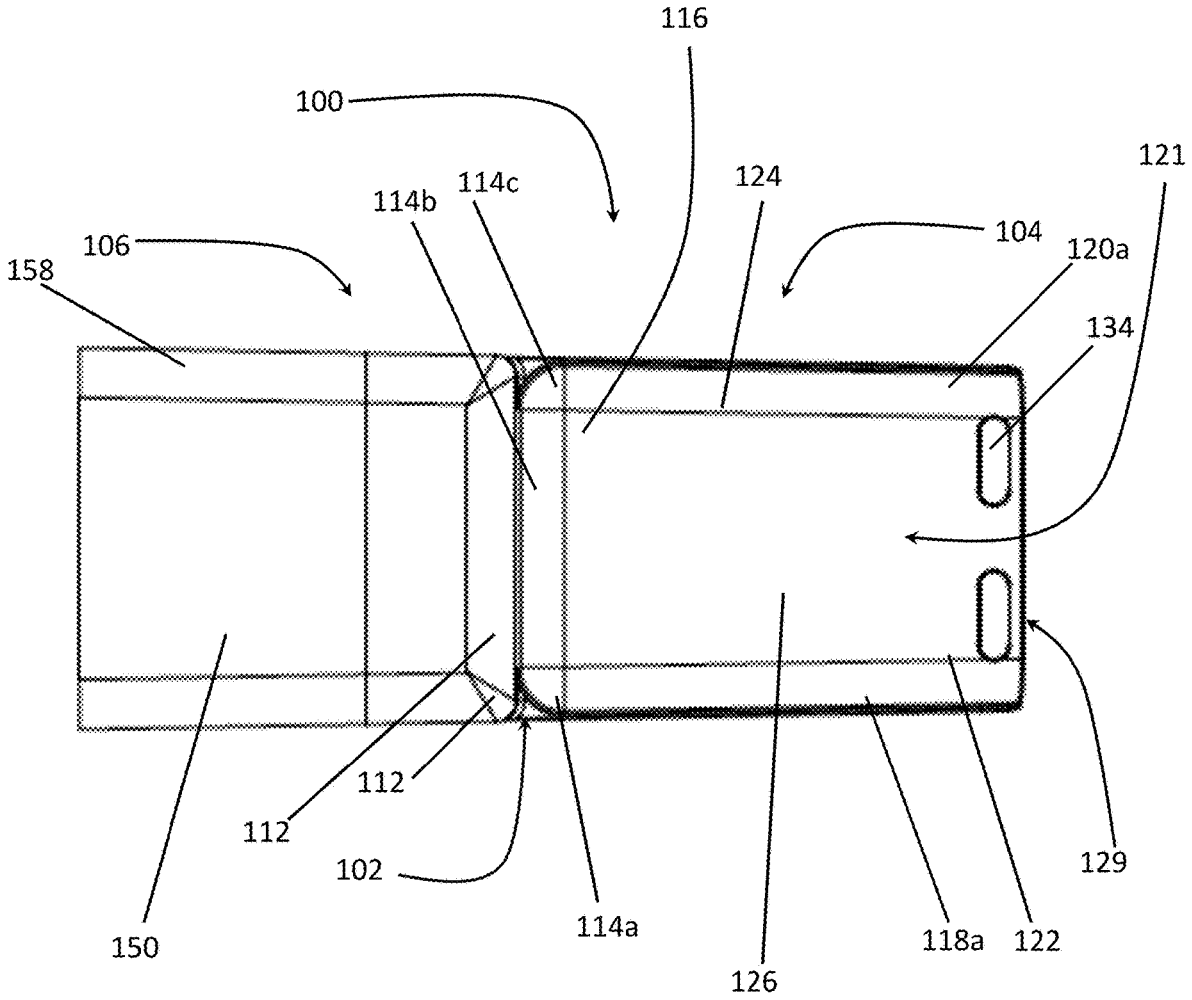
FIG. 2 is a top view of the scoop of FIG. 1.

As another example, as shown in FIGS. 1 and 2, the scoop portion 104 includes one or more openings 134 (e.g., windows) that extend through the bottom scoop wall 116 (e.g., between the first surface 126 and the second surface 128 of the bottom scoop wall 116). For example, as shown in FIGS. 1 and 2, the scoop portion 104 includes two openings 134 through the bottom scoop wall 116, though more or fewer openings may be provided. The two openings 132 are positioned next to and at a distance relative to each other, and are positioned adjacent to (e.g., within 5 cm or 10 cm) the front edge 129 of the scoop portion 104. The openings 134 may be any number of shapes (e.g. oval-shaped, as shown in FIGS. 1 and 2) and sizes, and may be provided in any number of positions relative to the front edge 129 of the scoop portion 104. In other embodiments, the scoop portion 104 includes openings through additional and/or different walls of the scoop portion 104. For example, the scoop portion 104 may include one or more openings through one or both of the opposed side scoop walls 118, 120.

The openings 134 may reduce friction between, for example, the first surface 126 of the bottom scoop wall 116 and the ice being scooped at or adjacent to the front edge 132 of the scoop portion 104. For example, the openings 134 may make moving the ice scoop 100 within the ice stored in the ice machine easier. The openings 134 may also be used for storage of the ice scoop 100. For example, the ice scoop 100 may be hung up within the ice machine via a hook or another extension within the ice machine through one or more of the openings 134. Other positions of the openings 134 (e.g., through one or both of the opposed side scoop walls 118, 120) may be provided.

As yet another example, as shown in FIGS. 1 and 2, the ice scoop 100 may include one or more supports 114 at one or more interfaces between the barrier 102 and the scoop portion 104, respectively. For example, as shown in FIGS. 1 and 2, the ice scoop 100 may include three supports 114: a first support 114*a* at an interface between a first 118 of the two opposed side scoop walls and the barrier 102; a second support 114*b* at an interface between the bottom scoop wall 116 and the barrier 102; and a third support 114*c* at an interface between a second 120 of the two opposed side scoop walls and the barrier 102. The ice scoop 100 may include more or fewer supports at additional and/or different interfaces of the ice scoop 100.

The first support 114*a*, the second support 114*b*, and/or the third support 114*c* may be rounded supports, such that at least part of the volume is a rounded rectangular prism. In one embodiment, the first support 114*a*, the second support 114*b*, and/or the third support 114*c* are triangular supports. Other shapes may be provided.

The rounded shape of the first support 114*a*, the second support 114*b*, and/or the third support 114*c* may be the result of a design choice. Alternatively, the rounded shape of the first support 114*a*, the second support 114*b*, and/or the third support 114*c* may result from a manufacturing process (e.g., molding) or may be included to make manufacturing the ice scoop 100 easier.

The first support 114*a*, the second support 114*b*, and/or the third support 114*c* may provide a number of benefits. For example, the first support 114*a*, the second support 114*b*, and/or the third support 114*c* may increase the rigidity of the ice scoop 100 at interfaces between the scoop portion 104 (e.g., the bottom scoop wall 116 and/or one or both of the opposed side scoop walls 118, 120) and the barrier 102. This increased rigidity may minimize flexing of the scoop portion 104 relative to the barrier 102 and/or prevent failure of the ice scoop 100 at the interfaces. As another example, the rounded shape of the first support 114*a*, the second support 114*b*, and/or the third support 114*c* may help prevent ice from getting stuck at the interfaces between the bottom scoop wall 116 and/or one or both of the opposed side scoop walls 118, 120, and the barrier 102, respectively.

Referring to FIGS. 1, 2, and 4-7, the handle portion 106 extends away from the barrier 102 (e.g., the second side 110 of the barrier 102). The handle portion 106 includes at least one wall (e.g., at least a first wall 150) that extends away from the second side 110 of the barrier 102. The barrier 102 and the at least one wall form a cavity 151 into which a hand of a user is insertable. A size and a shape of the cavity 151 is at least partially defined by a size and a shape of the barrier 102 and size(s) and shape(s) of wall(s) of the at least one wall.

In one example, the handle portion 106 has a rectangular-shaped cross-section (e.g., through a handle of the handle portion 106 and perpendicular to the bottom scoop wall 116) and includes the first wall 150 (e.g., a first hand protection wall; a top wall), a second wall 152 (e.g., a second hand protection wall; a bottom wall opposite the top wall 150; see FIG. 4), and a third wall 154 and a fourth wall 156 (e.g., a third hand protection wall and a fourth hand protection wall; two opposed side walls) extending between the first wall 150 and the second wall 152. In other words, in one embodiment, the handle portion 106 has at least four hand protection walls 150, 152, 154, 156 extending away from the second side 110 of the barrier 102.

The four hand protection walls 150, 152, 154, 156 are connected directly to the second side 110 of the barrier 102. Alternatively, the handle portion 106 includes one or more wall portions disposed between, for example, the four hand protection walls 150, 152, 154, 156 and the second side 110 of the barrier 102 (e.g., the wall portions 112) but still extend away form the second side 110 of the barrier 102. In one embodiment, the first wall 150 and/or the second wall 152 is parallel to the bottom scoop wall 116. In other embodiments, the first wall 150 and/or the second wall 152 is at an angle relative to the bottom scoop wall 116.

In another example, the handle portion 106 has an elliptical-shaped (e.g., circular-shaped) cross-section (e.g., through the handle of the handle portion 106 and perpendicular to the bottom scoop wall 116) and includes only the first wall 150. Other numbers of walls extending away from the second side 110 of the barrier 102 may be provided.

As shown in FIGS. 1 and 3, the handle portion 106 includes five curved wall portions 112 that connect the handle portion 106 to the barrier 102, respectively. More or fewer curved wall portions may be provided. In other examples, the handle portion 106 does not include any curved wall portions 112 connecting the handle portion 106 to the barrier 102, and all walls of the handle portion 106 are connected to and extend in directions away from (e.g., perpendicular to) the second side 110 of the barrier 102, respectively.

Figure 5:
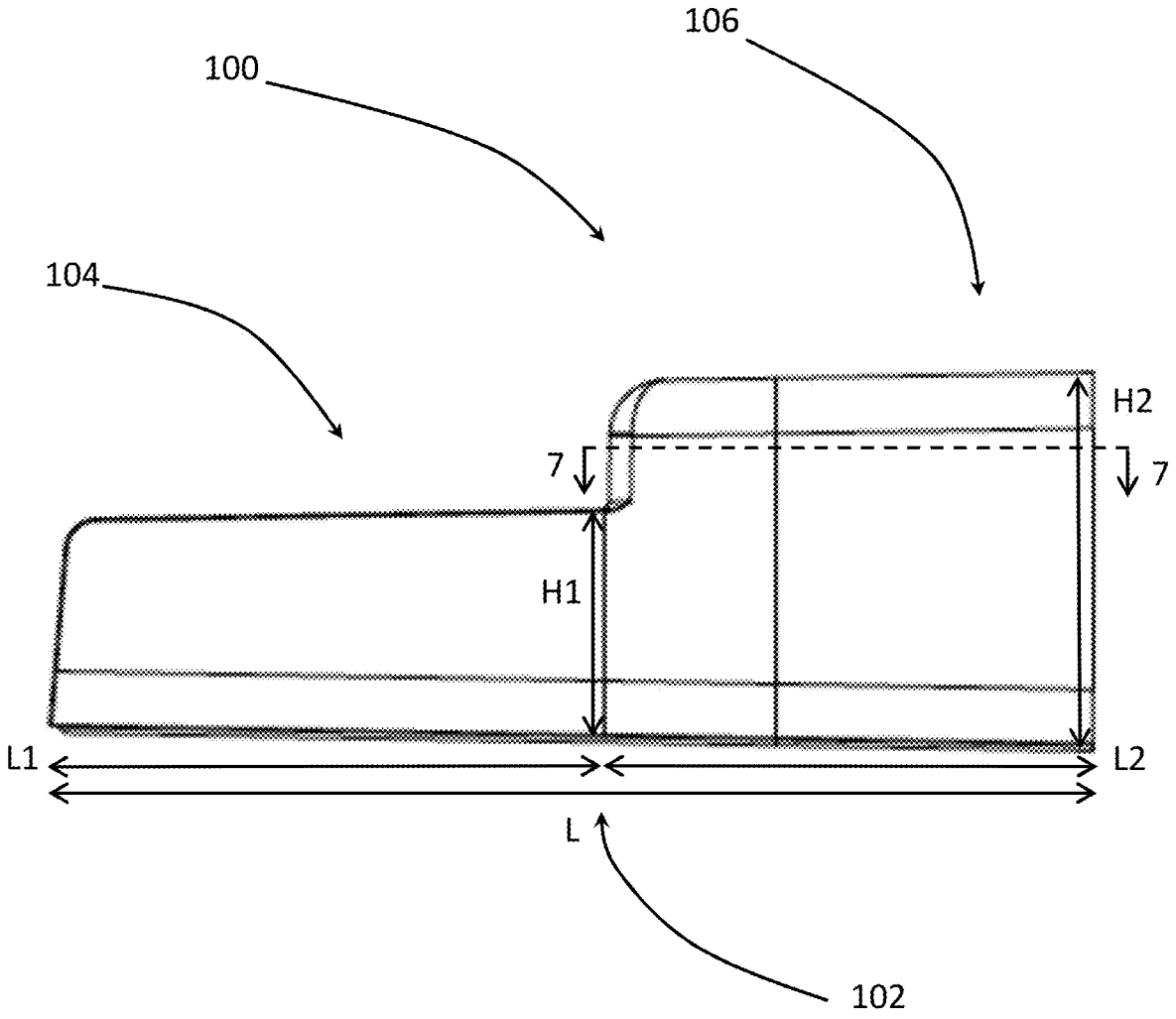
FIG. 5 is a side view of the scoop of FIG. 1.
Figure 6:
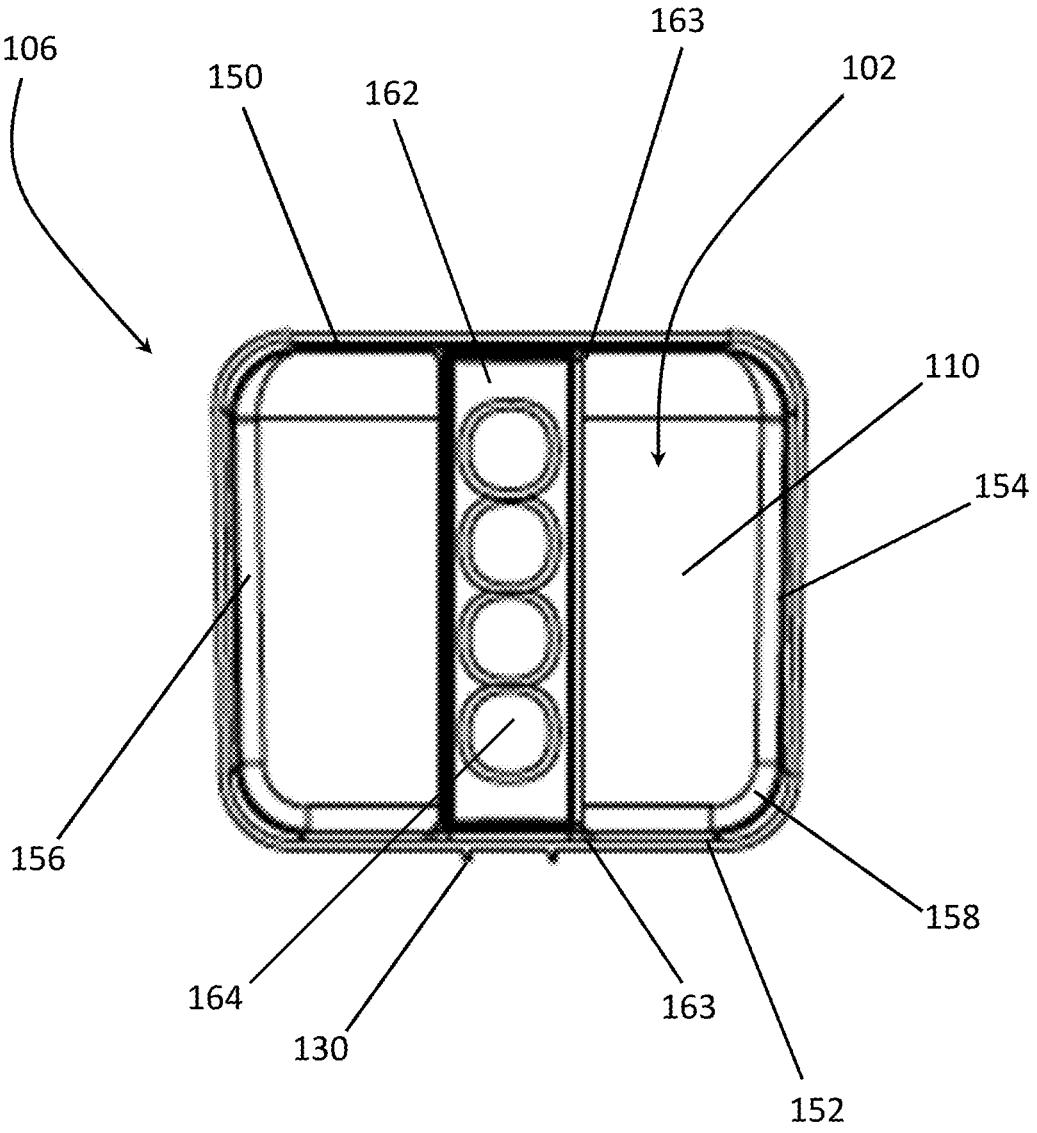
FIG. 6 is a rear view of the scoop of FIG. 1.

As shown in FIGS. 4 and 6, a cross-section of the handle portion 106 (e.g., through the handle of the handle portion 106 and perpendicular to the bottom scoop wall 116) is rectangular with rounded corners (e.g., rounded rectangular). In the embodiments shown in FIGS. 1-7, the handle portion 106 includes the first wall 150, the second wall 152, the third wall 154, the fourth wall 156, and curved wall portions 158 between each adjacent pair of walls of the first wall 150, the second wall 152, the third wall 154, and the fourth wall 156.

At least the first wall 150, the third wall 154, the fourth wall 156, and the curved wall portions 158 between the first wall 150 and the third wall 154, and between the first wall 150 and the fourth wall 156, respectively, are connected to corresponding ones of the curved wall portions 112. In one embodiment, the second wall 152 is directly connected to the second side 110 of the barrier 102 and extends in a direction away from the second side 110 of the barrier 102. In another embodiment, the second wall 152 is directly connected to the bottom scoop wall 116 (e.g., at an end) and/or the barrier 102 (e.g., at an inner surface of the second wall 152). The first wall 150, the second wall 152 (e.g., at least a portion), the third wall 154, and the fourth wall 156 extend in directions away from the second side 110 of the barrier 102, respectively.

In one embodiment, the third wall 154 and/or the fourth wall 156 extend between the first wall 150 and the second wall 152 in directions that are perpendicular to the first wall 150, the second wall 152, and/or the bottom scoop wall 116, respectively. In other embodiments, the third wall 154 and/or the fourth wall 156 extend between the first wall 150 and the second wall 152 in non-perpendicular directions relative to the first wall 150, the second wall 152, and/or the bottom scoop wall 116, respectively.

In one embodiment, the first wall 150, the second wall 152, the third wall 154, the fourth wall 156, and the curved wall portions 158 extend away from the second side 110 of the barrier 102 in directions perpendicular to the second side 110 of the barrier 102, respectively. In another embodiment, the first wall 150, the second wall 152, the third wall 154, the fourth wall 156, at least some of the curved wall portions 158, or any combination thereof extend away from the second side 110 of the barrier 102 in non-perpendicular directions relative to the second side 110 of the barrier 102, respectively, such that, for example, the cavity 151 at an end 160 of the handle portion 106 is larger than at the barrier 102 (see FIG. 2).

A size of a cross-section of the cavity 151 (e.g., through the handle of the handle portion 106 and perpendicular to the bottom scoop wall 116) is defined by sizes of the at least one wall 150. For example, the size of the cross-section of the cavity 151 may be defined by sizes of the first wall 150, the second wall 152, the third wall 154, the fourth wall 156, and the curved wall portions 158, respectively. The size of the cross-section of the cavity 151 may be any number of sizes. For example, the size of the cross-section of the cavity 151 may be such that a largest dimension across the cavity 151 is six inches, seven inches, or eight inches. Other sizes may be provided.

Referring to FIG. 5, the ice scoop 100 may be any number of different lengths L set based on a thickness of the barrier 102, a length L1 of the scoop portion 104, and a length L2 of the handle portion 106. The length L1 of the scoop portion 104 may be set based on an amount (e.g., a volume) of, for example, ice to be scooped. A longer L1 provides a greater volume defined by the bottom scoop wall 116 and the opposed side scoop walls 118, 120 of the scoop portion 104 for transporting ice.

The length L2 of the handle portion 106 may be set based on an amount (e.g., a length) of a user's hand/arm to be disposed within the handle portion 106 when the user is using the ice scoop. In other words, the length L2 of the handle portion 106 may define how much of the hand/arm is to be protected from contact with ice within the ice machine. In one embodiment, the length L2 of the handle portion 106 is approximately the same as the length L1 of the scoop portion 104 (e.g., within two inches of the length L1). In another embodiment, the length L1 of the scoop portion 104 is greater than the length L2 of the handle portion 106, or the length L2 of the handle portion 106 is greater than the length L1 of the scoop portion 104.

As shown in FIG. 5, the scoop portion 104 may have a different height than the handle portion 106. For example, a height H1 of the scoop portion 104 (e.g., a maximum height H1 of the scoop portion 104) may be less than a height H2 of the handle portion 106 (e.g., a maximum height H2 of the handle portion 106). In one embodiment, the height H1 of the scoop portion 104 at the barrier 102 is the same as the height H2 of the handle portion 106 at the barrier 102. The height H1 of the scoop portion 104 may be constant along the length L1 of the scoop portion 104, or the height H1 of the scoop portion 104 may vary along the length L1 of the scoop portion 104. For example, as shown in FIG. 5, the height of the scoop portion 104 (e.g., respective heights of the opposed side scoop walls 118, 120) may decrease along the length L1 of the scoop portion 104 in a direction away from the barrier 102. The height H2 of the handle portion 106 may be constant along the length L2 of the handle portion 106, or the height H2 of the handle portion 106 may vary along the length L2 of the handle portion 106. In one embodiment, the maximum height H1 of the scoop portion 104 is located at the barrier 102, and the maximum height H2 of the handle portion 106 is located at the end 160 of the handle portion 106

Referring to FIG. 6, walls of the handle portion 106 may be any number of thicknesses. For example, the first wall 150, the second wall 152, the third wall 154, and the fourth wall 156 may have respective thicknesses set based on how much the handle portion 106 is allowed to flex when the ice scoop 100 is in use. The greater the thicknesses of the first wall 150, the second wall 152, the third wall 154, and the fourth wall 156, respectively, the less the handle portion 106 may be able to flex when the ice scoop 100 is in use. In one embodiment, all walls of the handle portion 106 have a same thickness. In other embodiments, at least some walls of the handle portion 106 have different thicknesses, respectively. For example, the first wall 150 and the second wall 152 may have a greater thickness than the third wall 154 and the fourth wall 156.

Figure 7:
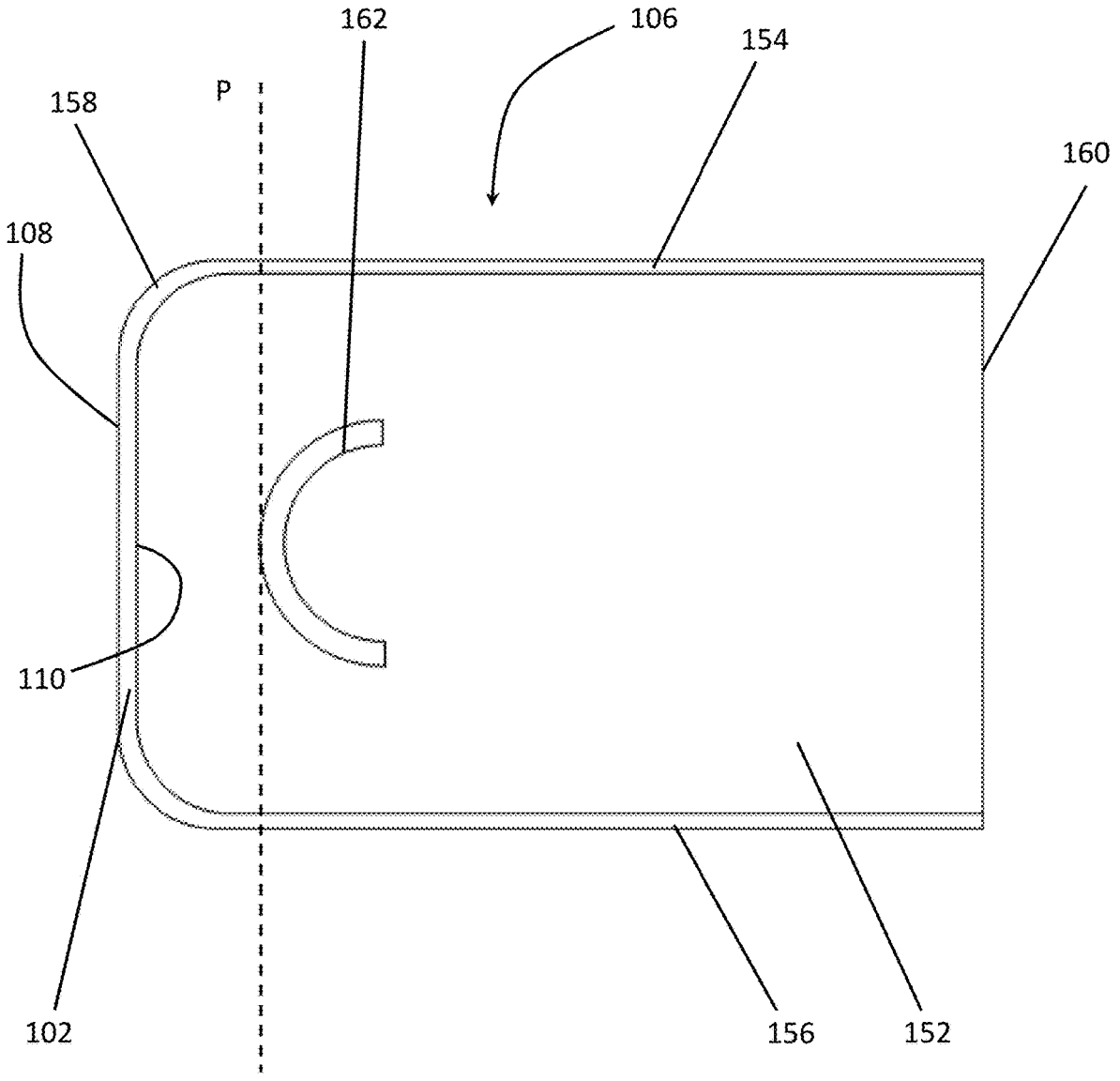
FIG. 7 is a top cross-sectional view of a handle portion of the scoop of FIG. 1.

Referring to FIGS. 6 and 7, the handle portion 106 includes a handhold 162 (e.g. a handle) attached to one or more walls of the at least one wall of the handle portion 106. For example, the handhold 162 may be attached to the first wall 150 and/or the second wall 152 of the handle portion 106. Additionally or alternatively, the handhold 162 may be attached to the barrier 102.

In one embodiment, the handhold 162 is removably attached to the handle portion 106 (e.g., the first wall 150 and the second wall 152). The handhold 162 may be removably attached to the one or more walls of the handle portion 106 in any number of ways including, for example, with grooves, flanges, extensions, fasteners, a friction fit, other connectors, or any combination thereof. For example, as shown in FIG. 6, each of the first wall 150 and the second wall 152 includes grooves 163, in which opposite ends of the handhold 162 are removably positioned. A combination of the handhold 162 being positioned in the grooves 163 and, for example, a friction fit may keep the handhold 162 in place. The handhold 162 may be removably attached to the handle portion 106 in other ways.

The removability of the handhold 162 may allow for easy cleaning of the ice scoop 100. For example, the handhold 162 may be hand washed or may be passed through a dishwasher separate from the rest of the ice scoop 100. This may allow for, for example, easier and more thorough cleaning of the handhold 162 compared to an ice scoop with the handhold 162 integrally formed with the rest of the ice scoop 100.

As shown in FIG. 6, the handhold 162 may extend from the first wall 150, across the cavity 151, to the second wall 152. In one embodiment, the handhold 162 extends from the first wall 150 or the second wall 152, only partially across the cavity 151, towards the second wall 152 or the first wall 150, respectively. The handhold 162 may extend between the first wall 150 and the second wall 152 in a direction perpendicular to the first wall 150 (e.g., an inner surface of the first wall 150), the second wall 152 (e.g., an inner surface of the second wall 152), and/or the bottom scoop wall 118 (e.g., a surface of the bottom scoop wall 118), and/or in a direction parallel to the third wall 154 (e.g., an inner surface of the third wall 154) and/or the fourth wall 156 (e.g., an inner surface of the fourth wall 156). As an example, a longitudinal axis of the handhold 162 extends in a direction perpendicular to the inner surface of the first wall 150 and perpendicular to the inner surface of the second wall 152.

Other configurations may be provided. For example, the handhold 162 may be rotated ninety degrees, such that the handhold 162 extends from the third wall 154, across the cavity 151, to the fourth wall 156. The handhold 162 may extend between the third wall 154 and the fourth wall 156 in a direction perpendicular to the third wall 154 and/or the fourth wall 156, and/or in a direction parallel to the first wall 150, the second wall 152, and/or the bottom scoop wall 118. In such a configuration, the handhold 162 may be attached (e.g., removably attached) to the third wall 154, the fourth wall 156, and/or the barrier 102. Other orientations of the handhold 162 (e.g., relative to the second wall 152 or the bottom scoop wall 118) may be provided. In another example, the handhold 162 is attached to and extends away from the second side 110 of the barrier 102. For example, the handhold 162 is centered between the first wall 150 and the second wall 152, and the third wall 154 and the fourth wall 156, respectively, and extends away from the barrier 102 in a direction that is, for example, parallel to the first wall 150, the second wall 152, and/or the bottom scoop wall 118. The handhold 162 may extend away from the second side 110 of the barrier 102 in other directions (e.g., non-perpendicular directions relative to the second side 110 of the barrier 102).

The handhold 162 includes one or more openings 164 through the handhold 162. For example, as shown in FIG. 6, the handhold 162 may include four openings 164 through the handhold 162. The handhold 162 may include more or fewer openings 164.

The four openings 164 may be any number of different sizes and shapes (e.g., oval-shaped or circular), and may be positioned on the handhold 162 in any number of different ways (e.g., positioned adjacent to each other along a longitudinal axis of the handhold 162). The four openings 164, for example, may be sized, shaped, and positioned relative to each other and/or relative to the first wall 150 and/or the second wall 152 for comfortable positioning of four fingers of the user's hand through the openings 164. The handhold 162 may be shaped, such that portions of the four fingers of the user's hand, for example, may be wrapped around the handhold 162 after insertion of the four fingers of the user's hand through the, for example, four openings 164 through the handhold 162.

Referring to FIG. 7, the handhold 162 may be any number of shapes for comfortable and secure gripping of the handhold 162 and thus, the ice scoop 100. For example, as shown in the embodiment of FIG. 7, the handhold 162 may be semi-cylindrical. Other shapes such as, for example, semi-elliptical, triangular, or rectangular may be provided. The handhold 162 may be solid, except for the openings 164 through the handhold 162, or may be hollow, as shown in FIG. 7. The hollow semi-cylindrical handhold 162 may be any number of thicknesses.

FIG. 7 depicts a plane P through the handhold 162 and perpendicular to the bottom scoop wall 116 and/or one or more walls of the at least one wall of the handle portion 106. For example, the plane P shown in FIG. 7 is perpendicular to at least the first wall 150, the second wall 152, the third wall 154, the fourth wall 156, and the bottom scoop wall 116, and extends through the handhold 162.

The at least one wall of the handle portion 106 (e.g., the first wall 150, the second wall 152, the third wall 154, and the fourth wall 156, together with the curved wall portions 158) surrounds (e.g., completely surrounds) the handhold 162 and thus, the user's hand when the user is gripping the handhold 162, at least in the plane P. In the embodiment shown in FIG. 7, the at least one wall of the handle portion 106 (e.g., the first wall 150, the second wall 152, the third wall 154, and the fourth wall 156, together with the curved wall portions 158) also surrounds (e.g., completely surrounds) a volume between the second side 110 of the barrier 102 and the plane P through the handhold 162 (e.g., in planes parallel to the plane P). The at least one wall of the handle portion 106 (e.g., the first wall 150, the second wall 152, the third wall 154, and the fourth wall 156, together with the curved wall portions 158) may also surround (e.g., completely surrounds) a volume between the plane P through the handhold 162 and the end 160 of the handle portion 106 (e.g., in planes parallel to the plate P). In other words, the handle portion 106 of the ice scoop 100 (e.g., the barrier 102, the curved wall portions 112 of the handle portion 106, the first wall 150, the second wall 152, the third wall 154, the fourth wall 156, and the curved wall portions 158) surrounds the portion of the user's hand, or hand and arm disposed within the handle portion 106 except at the end 160 of the handle portion 106.

As shown in FIG. 7, the handhold 162 may be positioned closer to the barrier 102 than the end 160 of the handle portion 106, though other positioning may be provided. The positioning of the handhold 162 relative to the barrier 102 may be set, such that the user has enough space within the volume between the handhold 162 and the second side 110 of the barrier 102, after inserting her fingers through the holes 164 through the handhold 162, to wrap her fingers around the handhold 162. Alternatively or additionally, a distance between the end 160 of the handle portion 106 and the handhold 162 may be maximized, such that an amount of the user's hand/arm positionable within the handle portion 106 is maximized.

Figure 8:
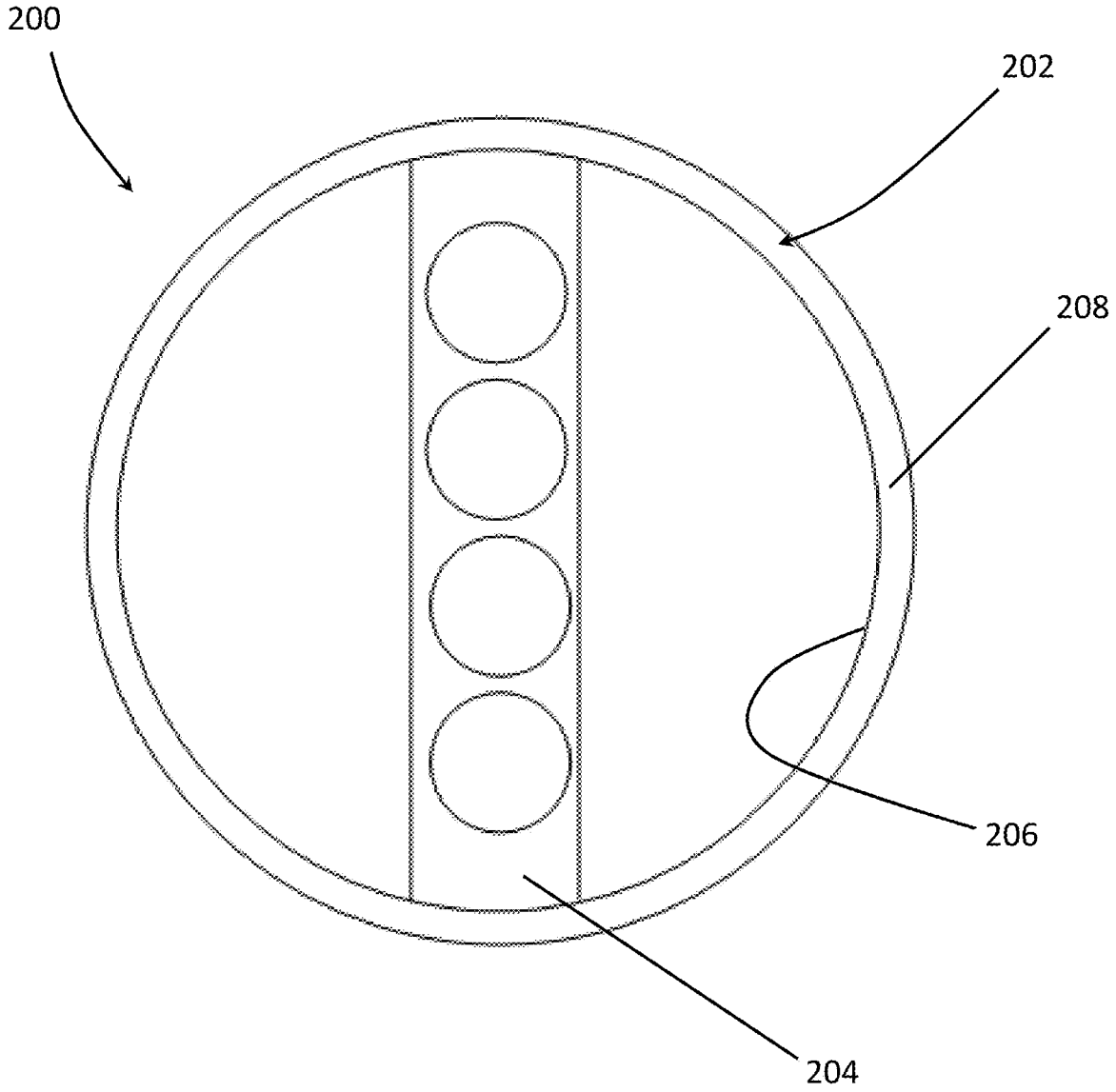
FIG. 8 is a rear view of another embodiment of a scoop.

FIG. 8 illustrates a second embodiment of an ice scoop 200. The ice scoop 200 includes a handle portion 202, and the handle portion 202 includes a handhold 204 (e.g., a handle). The handle portion 202 of the ice scoop 200 is elliptical-shaped (e.g., circular). For example, a cross-section of the handle portion 202 through the handhold 204 is circular-shaped. The handhold 204 extends between opposite points on an inner surface 206 of a wall 208 at least partially forming the handle portion 202. The handhold 204 is attached (e.g., removably attached) to the wall 208 at the opposite points on the inner surface 206 of the wall 208. Other configurations of the handhold 204 within the handle portion 202, and other shapes of the handle portion 202 may be provided.

An ice scoop (e.g., the ice scoop 100 illustrated in FIGS. 1-7, the ice scoop 200 illustrated in FIG. 8, or another scoop or ice scoop) may be made of any number of different materials. For example, the ice scoop is made of a plastic (e.g., polycarbonate, polyethylene, and/or polypropylene), a metal (e.g., aluminum), and/or one or more other materials. In one embodiment, the entire ice scoop is made of a single material. In other embodiments, different parts or portions of the ice scoop are made of different materials, respectively. For example, with reference to the embodiment of the ice scoop shown in FIGS. 1-7, the handhold 162 may be made of a different material than the rest of the ice scoop 100. For example, the handhold 162 may be made of a first plastic with a first hardness, and the rest of the ice scoop 100 may be made of a second plastic with a second hardness, where the first hardness is greater than the second hardness. As another example, different portions (e.g., walls) of the scoop portion 104 and/or the handle portion 106 may be made of different materials. As yet another example, at least portions of the barrier 102, the scoop portion 104, and/or the handle portion 106 may be made of different materials, respectively.

The ice scoop (e.g., the ice scoop 100 illustrated in FIGS. 1-7, the ice scoop 200 illustrated in FIG. 8, or another scoop or ice scoop) may be manufactured in any number of ways. For example, the ice scoop may be manufactured using molding (e.g., injection molding or extrusion molding), machining, additive manufacturing (e.g., three-dimensionally (3D) printing), and/or other manufacturing processes. The ice scoop may be manufactured as a single contiguous part. Alternatively, the ice scoop may be manufactured as two or more separate parts and assembled.

For example, the handhold 162 and the rest of the ice scoop 100 may be separate parts. The ice scoop 100 may be disassembled for cleaning and reassembled for use. In another example, more than two parts may be separate parts. For example, the barrier 102, the scoop portion 104, walls of the handle portion 106 (e.g., the at least one wall), and the handhold 162 are all separate parts that may be disassembled for cleaning, and reassembled using, for example, tabs, flanges, openings, fasteners, and/or other connectors for use. In another example, individual walls of, for example, the scoop portion 104 and/or the handle portion may be separate parts that may be disassembled for cleaning and reassembled for use. For example, the first wall 150, the second wall 152, the third wall 154, and the fourth wall 156 may be separate parts. In yet another example, the at least one wall of the handle portion 106 is formed by a disposable piece of material (e.g., a sheet of plastic). The disposable piece of material may be shaped (e.g., formed into a cylindrical shape) and attached to the second side 110 of the barrier 102 in any number of ways including, for example, using one or more grooves in the second side 110 of the barrier 102, flanges, tabs, openings, fasteners, and/or other connectors. After a period of use (e.g., a single use of the ice scoop 100 or after a period of time such as a day or a work shift), the disposable piece of material may be removed from the ice scoop and discarded.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An ice scoop comprising:

a barrier having a first side and a second side opposite the first side;

a scoop portion extending away from the first side of the barrier; and a handle portion extending away from the second side of the barrier, the handle portion comprising:

one or more walls extending away from the second side of the barrier, the one or more walls of the handle portion and the barrier defining a cavity; and a handhold attached to a wall of the one or more walls, the barrier, or the wall and the barrier within the cavity, wherein the scoop portion has a bottom scoop wall and two opposed side scoop walls, the bottom scoop wall having opposed sides, the two opposed side scoop walls extending away from the opposed sides of the bottom scoop wall, respectively, wherein the one or more walls of the handle portion comprise only one wall, and wherein a cross section of the one wall in a plane perpendicular to the bottom scoop wall is elliptical at an inner surface of the one wall.

2. The ice scoop of claim 1, wherein the one or more walls surround the handhold in a plane through the handhold and perpendicular to the bottom scoop wall.

3. The ice scoop of claim 1, wherein the cross section of the one wall in the plane perpendicular to the bottom scoop wall is circular at the inner surface of the one wall.

4. The ice scoop of claim 1, wherein the handhold extends across the cavity and is connected to the inner surface of the one wall.

5. The ice scoop of claim 1, wherein the handhold is semi-cylindrical.

6. The ice scoop of claim 5, wherein the handhold has a plurality of openings through the handhold, the plurality of openings being positioned next to each other along a longitudinal axis of the handhold.

7. The ice scoop of claim 1, wherein the barrier, the scoop portion, and the handle portion are a single contiguous part.

8. A scoop comprising:

a barrier having a first side and a second side opposite the first side;

a scoop portion extending away from the first side of the barrier, the scoop portion having a scooping wall; and a handle portion extending away from the second side of the barrier, the handle portion comprising:

one or more hand protection walls extending away from the second side of the barrier, the one or more hand protection walls and the barrier defining a recess; and a handhold attached to a hand protection wall of the one or more hand protection walls, the barrier, or the hand protection wall and the barrier within the recess, wherein the one or more hand protection walls surround the handhold in a plane through the handhold and perpendicular to the scooping wall, and wherein the handhold is removably attached to the hand protection wall.

9. The scoop of claim 8, wherein the one or more hand protection walls comprise a first hand protection wall, a second hand protection wall opposite the first hand protection wall, and a third hand protection wall and a fourth hand protection wall extending between the first hand protection wall and the second hand protection wall at opposed sides of the first hand protection wall and the second hand protection wall, respectively.

10. The scoop of claim 9, wherein the handhold extends between and is connected to the first hand protection wall and the second hand protection wall.

11. An ice scoop comprising:

a barrier having a first side and a second side opposite the first side;

a scoop portion extending away from the first side of the barrier, the scoop portion having a scooping wall and two opposed side scoop walls, the scooping wall having opposed sides, the two opposed side scoop walls extending away from the opposed sides of the scooping wall, respectively; and a handle portion extending away from the second side of the barrier, the handle portion comprising:

a first hand protection wall, a second hand protection wall opposite the first hand protection wall, and a third hand protection wall and a fourth hand protection wall extending between the first hand protection wall and the second hand protection wall at opposed sides of the first hand protection wall and the second hand protection wall, respectively, the first hand protection wall, the second hand protection wall, the third hand protection wall, and the fourth hand protection wall extending away from the barrier and, with the barrier, defining a hollow; and a handhold attached to the first hand protection wall and the second hand protection wall within the hollow, the first hand protection wall being a top wall and the second hand protection wall being a bottom wall.

12. The ice scoop of claim 11, wherein first hand protection wall and the second hand protection wall are parallel to the scooping wall.

13. The ice scoop of claim 11, wherein a longitudinal axis of the handhold extends in a direction perpendicular to an inner surface of the first hand protection wall.

14. The ice scoop of claim 11, wherein the handhold is removably attached to the top wall and the bottom wall.

* * * * *